US008763404B2

(12) United States Patent
Eifert

(10) Patent No.: US 8,763,404 B2
(45) Date of Patent: Jul. 1, 2014

(54) SYSTEMS, APPARATUSES, AND METHODS OF HARNESSING THERMAL ENERGY OF GAS TURBINE ENGINES

(75) Inventor: Andrew Eifert, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 957 days.

(21) Appl. No.: 12/643,626

(22) Filed: Dec. 21, 2009

(65) Prior Publication Data

US 2010/0162704 A1 Jul. 1, 2010

Related U.S. Application Data

(60) Provisional application No. 61/204,059, filed on Dec. 31, 2008.

(51) Int. Cl.

| | |
|---|---|
| ***F02C 3/30*** | (2006.01) |
| ***F02K 99/00*** | (2009.01) |
| ***F02C 6/00*** | (2006.01) |

(52) U.S. Cl.
USPC ..... 60/775; 60/267; 60/39.182

(58) Field of Classification Search
USPC ..... 60/39.181, 39.182, 39.5, 266, 267, 775, 60/670
See application file for complete search history.

(56) References Cited

U.S. PATENT DOCUMENTS

| | | | | |
|---|---|---|---|---|
| 2,937,654 | A * | 5/1960 | Wilner | 137/68.13 |
| 3,046,741 | A | 7/1962 | Volk, Jr. | |
| 3,063,242 | A | 11/1962 | Broad | |
| 3,605,406 | A * | 9/1971 | Woolley | 60/39.182 |
| 3,646,760 | A * | 3/1972 | Waidelich | 60/204 |
| 4,214,450 | A | 7/1980 | Nagashima et al. | |
| 4,414,813 | A | 11/1983 | Knapp | |
| 4,693,213 | A | 9/1987 | Yanai et al. | |
| 5,174,107 | A | 12/1992 | Ogawa et al. | |
| 5,704,209 | A | 1/1998 | Bronicki et al. | |
| 5,778,675 | A | 7/1998 | Nakhamkin | |
| 5,925,223 | A | 7/1999 | Simpson et al. | |
| 6,715,296 | B2 | 4/2004 | Bakran et al. | |
| 6,748,733 | B2 | 6/2004 | Tamaro | |
| 6,941,760 | B1 | 9/2005 | Jones | |
| 6,945,052 | B2 | 9/2005 | Frutschi et al. | |
| 7,194,861 | B2 * | 3/2007 | Bishop | 60/659 |
| 2002/0050134 | A1 | 5/2002 | Bronicki et al. | |
| 2002/0116930 | A1 | 8/2002 | Anderson | |

* cited by examiner

*Primary Examiner* — Ehud Gartenberg
*Assistant Examiner* — Arun Goyal
(74) *Attorney, Agent, or Firm* — Krieg DeVault, LLP

(57) ABSTRACT

One embodiment according to the present invention is a unique system for harnessing thermal energy of a gas turbine engine. Other embodiments include unique apparatuses, systems, devices, and methods relating to gas turbine engines. Further embodiments, forms, objects, features, advantages, aspects, and benefits of the present invention shall become apparent from the following description and drawings.

16 Claims, 6 Drawing Sheets

SYSTEMS, APPARATUSES, AND METHODS OF HARNESSING THERMAL ENERGY OF GAS TURBINE ENGINES

CROSS REFERENCE TO RELATED APPLICATIONS

The present application claims the benefit of U.S. Provisional Patent Application No. 61/204,059, filed Dec. 31, 2008, and is incorporated herein by reference.

GOVERNMENT RIGHTS

The present application was made with the United States government support under Contract No. N88858, awarded by the United States Navy. The United States government has certain rights in the present application.

FIELD OF THE INVENTION

The present invention relates generally to gas turbine engines and more particularly to systems, apparatuses, and methods of harnessing thermal energy of gas turbine engine(s).

BACKGROUND

Gas turbine engines are an efficient source of energy and have proven useful to propel aircraft and other flying machines, for electricity generation, as well as for other uses. One aspect of gas turbine engines is that they produce significant amounts of thermal energy during operation. It is well understood that some thermal energy is harnessed by a gas turbine engine during its operation; however, a significant amount of thermal energy is not harnessed or put to use and is lost. Thus, there remains a need for systems, apparatuses, and methods of harnessing thermal energy of gas turbine engine(s).

SUMMARY

One embodiment according to the present invention is a unique system for harnessing thermal energy of a gas turbine engine. Other embodiments include unique apparatuses, systems, devices, and methods relating to gas turbine engines. Further embodiments, forms, objects, features, advantages, aspects, and benefits of the present invention shall become apparent from the following description and drawings.

DETAILED DESCRIPTION

Figure 1:
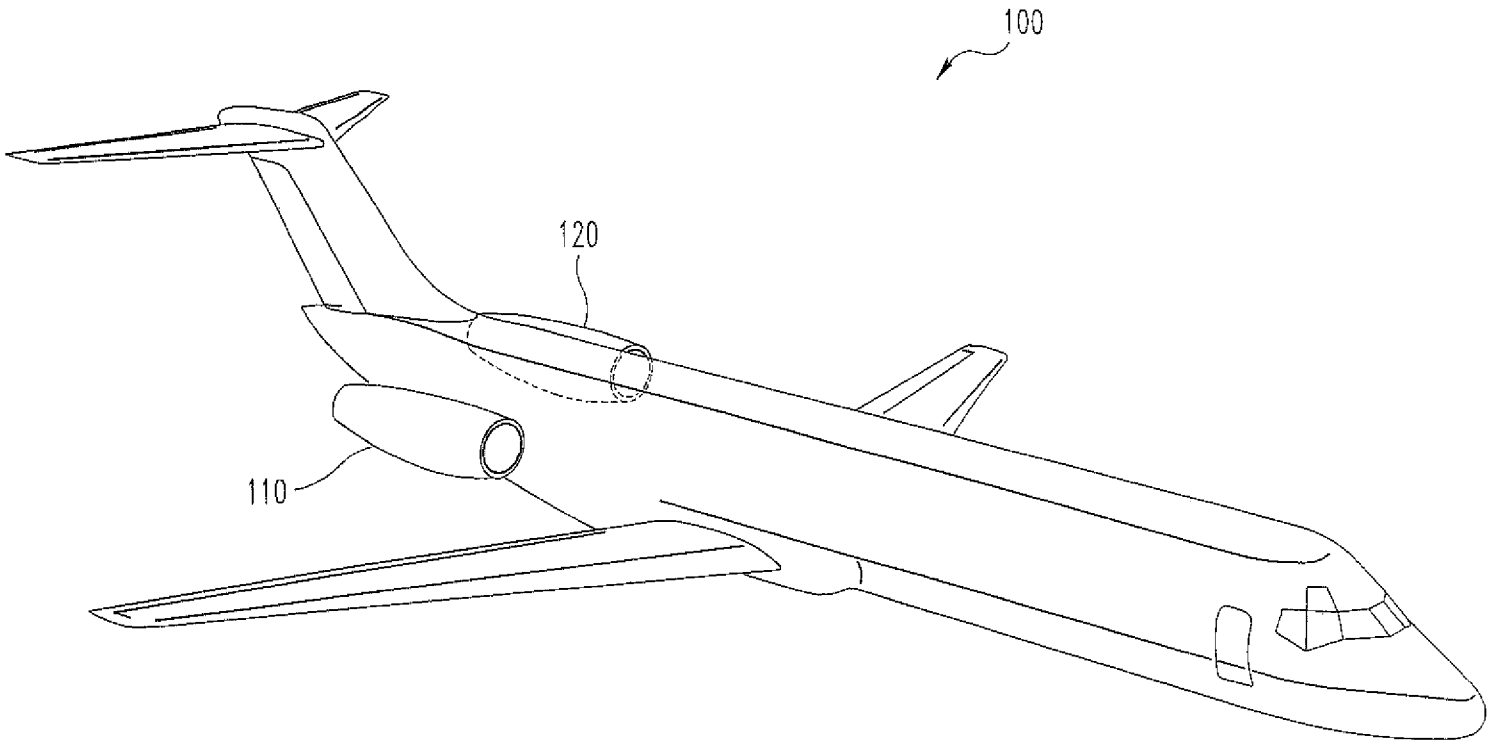
FIG. 1 is an illustrative view of an aircraft propelled by two gas turbine engines.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is shown airplane 100 including gas turbine engine engines 110 and 120 which operate to propel airplane 100. Airplane 100 is one example of a use to which gas turbine engines can be put. There are a variety of additional applications for gas turbine engines, including, for example, electricity generation, pumping sets for gas and oil transmission lines, land and naval propulsion, and still other applications. It should be appreciated that systems, apparatuses, and methods according to the present invention can be used in connection with the gamut of gas turbine engine applications. Thus, while the following description is in the context of one embodiment of a gas turbine engine suitable for aircraft propulsion, the invention broadly applies to the aforementioned applications and others.

Figure 2:
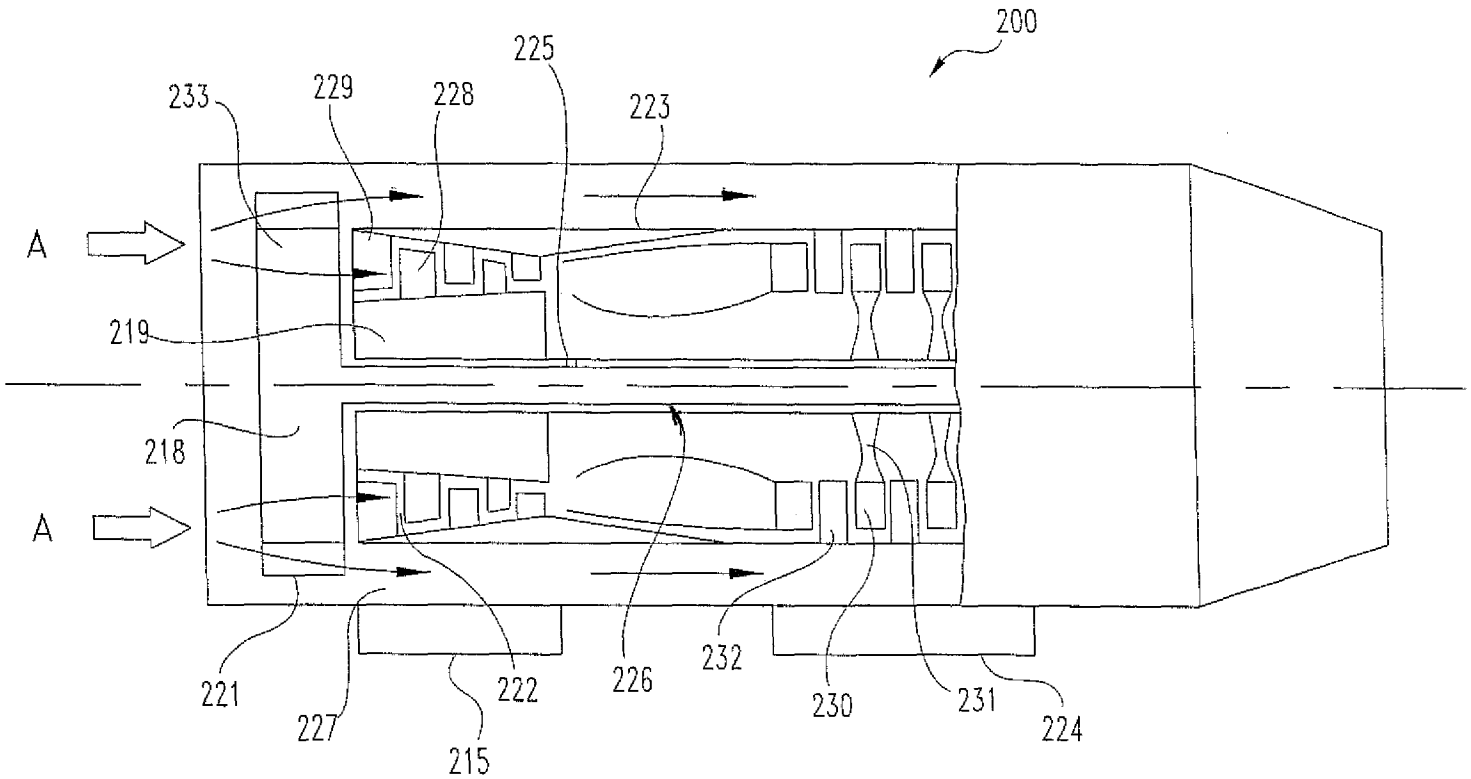
FIG. 2 is a schematic representation of a gas turbine engine.

With reference to FIG. 2, there is illustrated a schematic view of a gas turbine engine 200 which includes a compression system 215, a combustor section 223, and a turbine section 224 that are integrated together to produce an aircraft flight propulsion engine. In one form, the compression system 215 includes a fan section 221 and a compressor section 222. This type of gas turbine engine is generally referred to as a turbo-fan. One alternate form of a gas turbine engine includes a compressor, a combustor, and a turbine that have been integrated together to produce an aircraft flight propulsion engine without-the fan section. The term aircraft broadly includes helicopters, airplanes, missiles, unmanned space devices and any other substantially similar devices. It is important to appreciate that there are a multitude of ways in which the gas turbine engine components can be linked together. For example, additional compressors and turbines could be added with intercoolers connecting between the compressors and reheat combustion chambers could be added between the turbines. A wide variety of additional configurations and variations are also possible.

The compressor section 222 includes a rotor 219 having a plurality of compressor blades 228 coupled thereto. The rotor 219 is affixed to a shaft 225 that is rotatable within the gas turbine engine 200. A plurality of compressor vanes 229 are positioned within the compressor section 222 to direct the fluid flow relative to blades 228. Turbine section 224 includes a plurality of turbine blades 230 that are coupled to a rotor disk 231. The rotor disk 231 is affixed to the shaft 225, which is rotatable within the gas turbine engine 200. Energy extracted in the turbine section 224 from the hot gas exiting the combustor section 223 is transmitted through shaft 225 to drive the compressor section 222. Further, a plurality of turbine vanes 232 are positioned within the turbine section 224 to direct the hot gaseous flow stream exiting the combustor section 223.

The turbine section 224 provides power to a fan shaft 226, which drives the fan section 221. The fan section 221 includes a fan 218 having a plurality of fan blades 233. Air enters the gas turbine engine 200 in the direction of arrows A and passes through the fan section 221 into the compressor section 222 and a bypass duct 227. The term airfoil will be utilized herein to refer to fan blades, fan vanes, compressor blades, turbine blades, compressor vanes, and turbine vanes unless specifically stated otherwise. Further details related to the principles and components of a conventional gas turbine engine will not be described herein as they are known to one of ordinary skill in the art.

Figure 3:
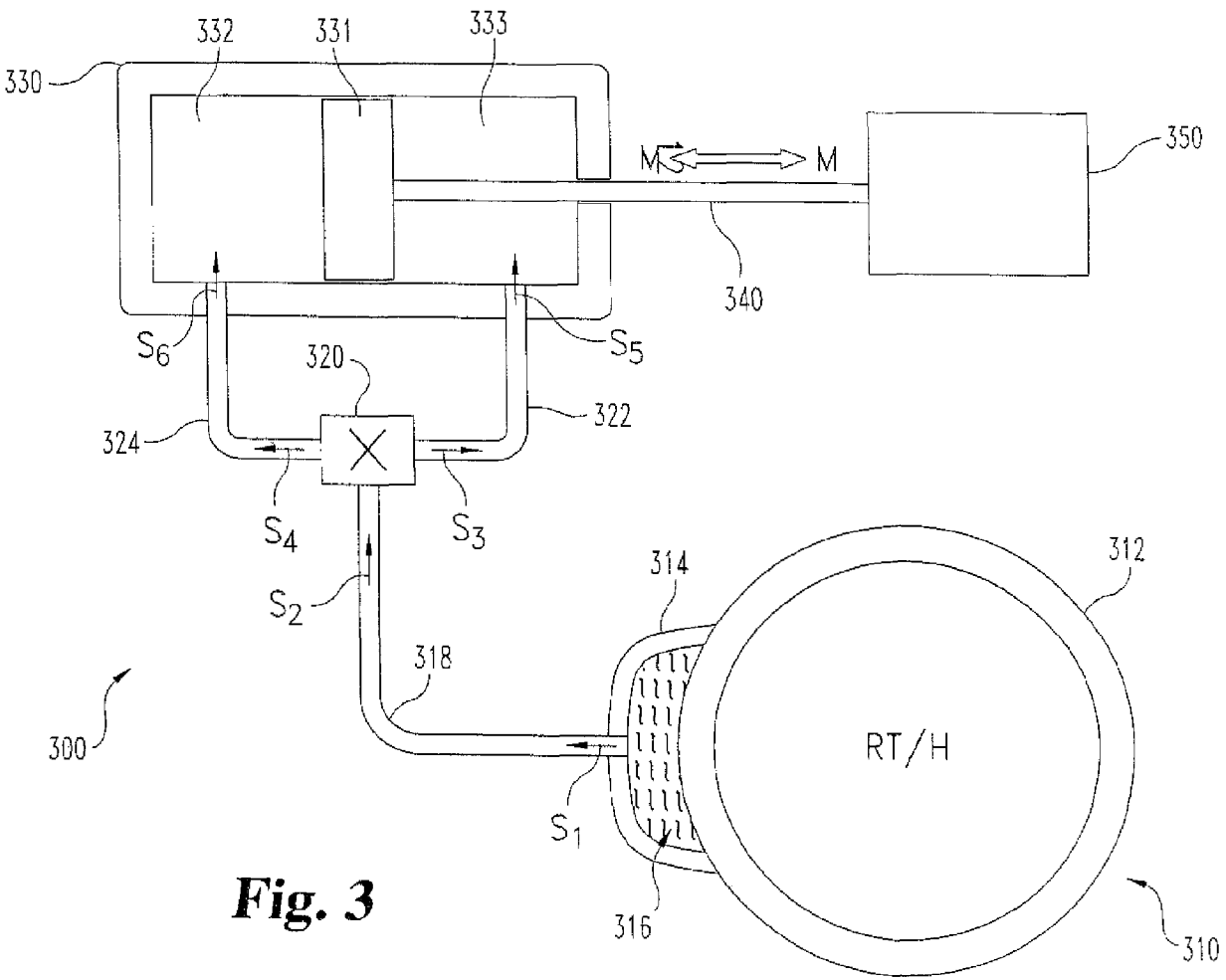
FIG. 3 is a system schematic according to one embodiment of the present invention.

With reference to FIG. 3 there is shown a system 300 according to one embodiment of the present invention. System 300 includes a gas turbine engine 310 which includes a housing 312. A chamber 314 is coupled to housing 312 and contains water 316. In an operational state, engine 310 rapidly becomes hot (for example up to 3000° C. or more) as indicates by letter H. In a non operational state engine 310 can be at room temperature, or at other non-operational temperatures as indicated by letters RT. At room temperature water 316 is in a substantially liquid physical phase; however, at an operational temperature, water 316 will undergo a phase change to become super heated steam. Given the high operating temperature of engine 310 this phase change can occur very rapidly, and can be nearly instantaneous upon engine operation. In certain applications, such as aircraft, additional heat can be generated on or about housing 314 through air drag. Such heat resulting from engine operation can be harnessed according to various embodiments of the present invention.

It should be appreciated that the illustrated coupling of engine 310 and chamber 314 where housing 312 and chamber 314 share a common wall is only one exemplary configuration. A number of other embodiments are contemplated, for example, coupling where the chamber is separated from the housing by one or more additional walls or other structures, or a portion of the chamber or some intermediate heat transfer structure extends into or through housing 312. Regardless of the particular configuration, system 300 includes thermal coupling of engine 310 and water 316 effective to promote or cause a phase change of water 316. Thermal coupling can include conduction, convention, radiation, or combination of these and other modes of heat transfer. It should also be appreciated that a variety of materials having the capacity to change phases within the operational/non-operational range of engine 310 could be used instead of or in addition to water. For example, materials such as other motive fluids for gas turbine engines or combinations of these or other materials could also be used. There may also be provided one or more devices to introduce additional water to chamber 314.

Chamber 314 is coupled to valve 320 by conduit 318. Though not illustrated, an additional valve, such as a steam valve or one way flow valve, can optionally be provided between chamber 314 and valve 320 to control movement of matter from chamber 314 to or at some position along conduit 318. Several such additional valves and other intermediate parts or pathways could also be included. Once water 316 changes phase to steam, assuming no barrier exists, it travels to or pressurizes a flow passage within conduit 318 as indicated by arrow $S_1$. Steam then travels through conduit 318 and ultimately encounters valve 320 as indicated by arrow $S_2$. Valve 320 can be closed, open to the right so that steam travels to conduit 322 in the direction indicated by arrow $S_3$, open to the left so that steam travels to conduit 324 in the direction indicated by arrow $S_4$, partially open in either or both directions, or open to provide external venting such as in the case of an emergency vent.

Conduits 322 and 324 are coupled to actuator 330. Conduit 322 leads to chamber 333 as illustrated by arrow $S_5$. Conduit 324 leads to chamber 332 as illustrated by arrow $S_6$. Thus, depending upon the setting of valve 320, the relative pressure of chambers 332 and 333 can be varied. Such variation can cause movement of piston 331 which in turn can move rod 340 and ultimately act upon load 350. As arrow M-M shows, this motion can be reciprocation. A variety or other movement can also occur, for example, rotation, vibration, twisting, torque, orbital motion, bending, and virtually any other manner of movement, force or action. It should also be appreciated that a variety of other actuators could be used to accomplish a variety of other purposes. For example, the actuator could include or could be coupled to a variable geometry actuator, such as a piston, operable to drive the variable geometry of a compressor. The actuator could include or could be coupled to an injector for direct injection into one or more locations in a gas turbine engine which could result in a variety of pollution and performance improvements. Furthermore, the actuator could include or could be coupled to an electrical generator such as a small steam turbine or other generation device. Additionally, the actuator could include or could be coupled to an injector for injection into the exhaust stream for IR or noise suppression purposes. Thus it will be understood that actuators according to various embodiments of the present invention include the foregoing and other devices operable to move, apply force, transfer matter such as steam or other motive fluid, and/or do some work.

Figure 4:
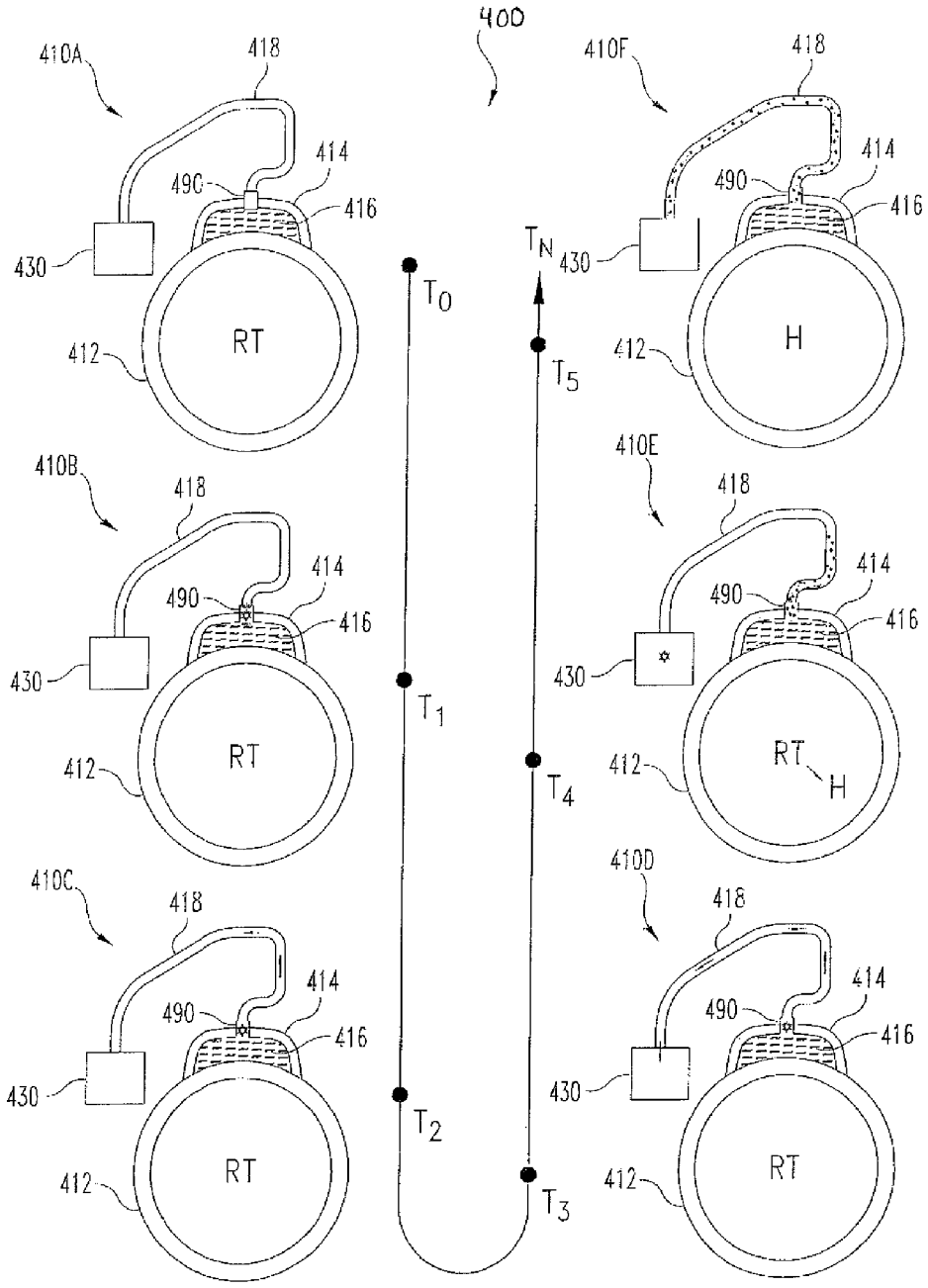
FIG. 4 is a schematic timeline of an apparatus in several states according to one embodiment of the present invention.
Figure 5:
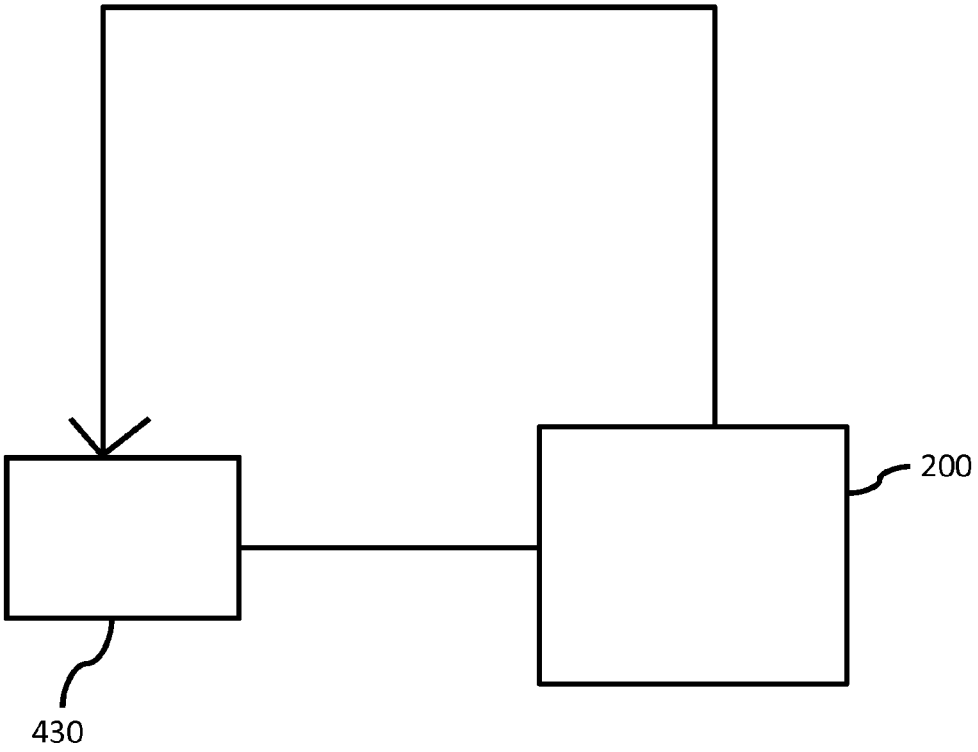
Figure 6:
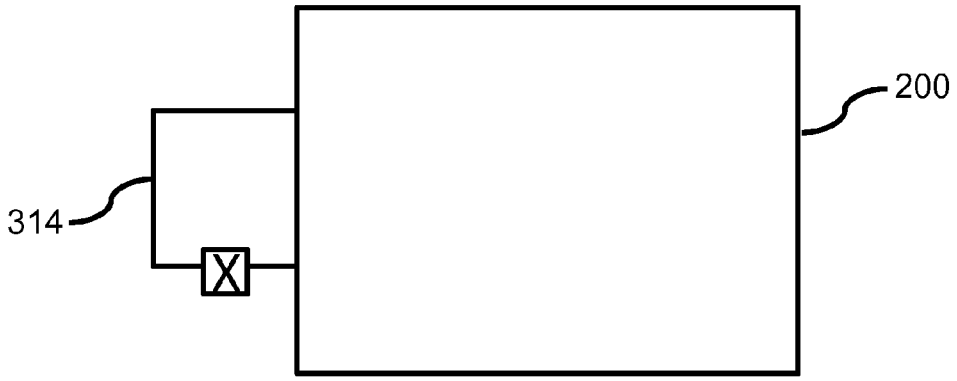

With reference to FIG. 4 there is shown a timeline 400 illustrating an apparatus 410 in several states 410A, 410B, 410C, 410D, 410E, and 410F. Each state corresponds to a time along timeline $T_O$-$T_N$, specifically, state 410A is at or about time $T_O$, state 410B is at or about time $T_1$, state 410C is at or about time $T_2$, state 410D is at or about time $T_3$, state 410E is at or about time $T_4$, and state 410F is at or about time $T_5$. The several states of apparatus 410 each include a gas turbine engine including a housing 412 which is coupled to a chamber 414 which contains a liquid or other phase excitable material. A flow path 418 can interconnect chamber 414 and actuator 430. There is also provided a triggerable pressure inducement element 490 which could be, for example, an explosive, a combustible, a valve opening to a pressure source such as a tank of flow passage, a cartridge, a compressor, an injector or any other source of pressure or combination of sources. For convenience element 490 is illustrated as an explosive; however, the foregoing and other alternatives are also contemplated.

Along the timeline $T_O$-$T_N$ apparatus 410 begins at $T_0$ in a room temperature or other non-operational state. Water or other matter 416 is in a liquid phase. Explosive 490 is unexploded, but triggerable by a variety of techniques. Then at $T_1$ explosive 490 is triggered. At $T_2$ explosive force begins traveling along pathway 418 as shown by the arrows. At $T_3$ the explosive force reaches actuator 430. At $T_4$ (which could be simultaneous or subsequent to $T_3$) actuator 430 is actuated. Also at (or before or subsequent to) $T_4$, the engine is started and moves from non-operational temperature to a hot operating state. Through transfer across a heat transfer interface, such as the illustrated intermediate metal wall structure, but optionally any of a wide variety of heat transfer structures including sinks, conductors, piping, counter flow, and/or combinations of these ant other interfaces, a phase change or excitement in matter 416 occurs. At $T_5$ the phase change or excitement reaches and actuates actuator 430.

While the invention has been described in connection with what is presently considered to be the most practical and preferred embodiment, it is to be understood that the invention is not to be limited to the disclosed embodiment(s), but rather, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow.

In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A system comprising:

a gas turbine engine;

a chamber thermally coupled to the gas turbine engine, the chamber containing a phase changeable matter;

an actuator in fluidic communication with the chamber via a conduit structured to convey the phase changeable matter as it travels from the chamber to the actuator;

a flow pathway coupling the chamber and the actuator; and an explosive trigger element disposed between the chamber and the actuator, the explosive trigger element structured to permit flow of fluid through the flow pathway away from the chamber when triggered, and structured to block flow in the pathway when the explosive trigger device has not been triggered;

wherein the system is operable such that heat from the engine operation induces a phase change of the phase changeable matter effective to actuate the actuator;

wherein the chamber and a housing of the gas turbine engine are physically interconnected, and the mode of thermal communication includes conduction; and wherein the chamber and the housing share a common wall and the mode of thermal communication further includes radiation.

2. The system of claim 1 wherein the phase changeable matter is water and the phase change is from a substantially liquid phase to a substantially gaseous phase.

3. The system of claim 1 wherein the phase changeable matter is a solid and the phase change is to a substantially liquid phase or a substantially gaseous phase.

4. The system of claim 1 further comprising a control valve operable to selectably route the phase changed matter to a portion of the actuator.

5. An apparatus comprising:

a gas turbine engine including a housing;

a container in thermal communication with the housing;

a phase excitable element in the container;

an actuator fluidically coupled to the container via a fluid conduit structured to convey the phase excitable element as it travels from the container to the actuator;

an explosive trigger device disposed between the container and the actuator and structured to block flow in the pathway when the explosive trigger device has not been triggered, the explosive trigger device structured to place the actuator in fluidic coupling to the container when triggered;

wherein the thermal communication permits heat transfer from the housing to the phase excitable element effective to pass the phase excitable element from the container to the actuator;

wherein the container and the housing of the gas turbine engine are physically interconnected, and the mode of thermal communication includes conduction; and wherein the container and the housing share a common wall and the mode of thermal communication further includes radiation.

6. The apparatus of claim 5 wherein the phase excitable element is liquid water when the engine is relatively cool and steam when the engine is relatively hot.

7. The apparatus of claim 5 further comprising a control means operable to route the phase excitable element to a first chamber of the actuator in a first control state and operable to route the phase excitable element to a second chamber of the actuator in a second control state.

8. The apparatus of claim 5 wherein the motion of the actuator is provided as feedback to a portion of the engine.

9. The apparatus of claim 5 further comprising a control valve operable to route the phase excitable element to a first chamber of the actuator in a first control state and operable to route the phase excitable element to a second chamber of the actuator in a second control state, and an exit valve operable to control escape from the container; wherein the container physically contacts the housing and the thermal communication includes conduction.

10. A method comprising:

operating a gas turbine engine, the engine including a heat transfer interface, the operating effective to transfer heat to the interface;

transferring thermal energy from the interface to phase changeable matter held in a container that is physically interconnected with the heat transfer interface such that a common wall is shared between the container and the heat transfer interface, the phase changeable matter in thermal communication with the interface through both conductive and convective heat transfer processes, the transferring effective to cause a phase change in the phase changeable matter;

explosively triggering a flow restrictor to permit the matter to flow through a conduit wherein before the flow restrictor is explosively triggered the flow restrictor acts to prohibit the conveyance of phase changeable matter through the conduit; and routing the phase changed matter through the conduit to actuate an actuator upon the explosively triggering the flow restrictor, wherein the conduit is connected between the container and the actuator.

11. The method of claim 10 wherein the phase change is a change from liquid phase to gaseous phase.

12. The method of claim 10 further comprising discharging an explosive prior the phase change, the discharging effective to actuate the actuator.

13. The method of claim 12 further wherein the discharging routes explosive pressure along a substantially similar pathway as is followed during the routing the phase changed matter.

14. The method of claim 10 further comprising controlling the routing to at least two pathways effective to move the actuator in at least two modes.

15. The method of claim 14 wherein the controlling is effective to cause reciprocation of at least a portion of the actuator.

16. The method of claim 10 wherein the phase change is from liquid water to super-heated steam, and further comprising discharging an explosive prior to operation of the engine effective to move at least a portion of the actuator prior to the phase change, wherein the discharging routes pressure along a substantially similar pathway as is followed during the routing.

* * * * *